US009388983B2

(12) United States Patent
Neumeier et al.

(10) Patent No.: US 9,388,983 B2
(45) Date of Patent: Jul. 12, 2016

(54) LOW NOX BURNER WITH LOW PRESSURE DROP

(71) Applicants: Yedidia Neumeier, Atlanta, GA (US); David S. Neff, Johns Creek, GA (US); Michael Pratte, Murrayville, GA (US); Joachim P. Sondervan, Atlanta, GA (US); Ghislain Retaureau, Atlanta, GA (US)

(72) Inventors: Yedidia Neumeier, Atlanta, GA (US); David S. Neff, Johns Creek, GA (US); Michael Pratte, Murrayville, GA (US); Joachim P. Sondervan, Atlanta, GA (US); Ghislain Retaureau, Atlanta, GA (US)

(73) Assignee: Plum Combustion, Inc., Atlanta, GA (US)

( * ) Notice: Subject to any disclaimer, the term of this patent is extended or adjusted under 35 U.S.C. 154(b) by 436 days.

(21) Appl. No.: 14/045,345

(22) Filed: Oct. 3, 2013

(65) Prior Publication Data

US 2015/0099232 A1 Apr. 9, 2015

(51) Int. Cl.

| | |
|---|---|
| ***F23D 14/02*** | (2006.01) |
| ***F23D 14/70*** | (2006.01) |
| ***F23D 14/62*** | (2006.01) |

(52) U.S. Cl.

CPC ..... *F23D 14/02* (2013.01); *F23D 14/62* (2013.01); *F23D 14/70* (2013.01); *F23D 2900/14021* (2013.01)

(58) Field of Classification Search

CPC ..... F23D 14/64; F23D 14/70
USPC ..... 431/6; 239/406
See application file for complete search history.

(56) References Cited

U.S. PATENT DOCUMENTS

| | | | | |
|---|---|---|---|---|
| 1,441,982 A | | 1/1923 | Heylman et al. | |
| 3,106,955 A | * | 10/1963 | Flasskamp | C09C 1/50 431/173 |
| 3,320,999 A | * | 5/1967 | Stalego | F23C 3/00 431/158 |
| 3,694,135 A | | 9/1972 | Dancy et al. | |
| 4,271,675 A | * | 6/1981 | Jones | F23R 3/14 239/406 |

(Continued)

FOREIGN PATENT DOCUMENTS

| | | |
|---|---|---|
| EP | 0486169 B1 | 10/1998 |
| EP | 0945678 A2 | 9/1999 |

(Continued)

OTHER PUBLICATIONS

Maxon Corporation:"Low NOx Burners SLS™ Technology"; 2013; https://www.maxoncorp.com/Directory/product_detail/SLS-Technology/75/.

(Continued)

*Primary Examiner* — Avinash Savani
(74) *Attorney, Agent, or Firm* — Bryan W. Bockhop; Bockhop Intellectual Property Law, LLC

(57) ABSTRACT

A burner includes a cylindrical tube that terminates in a burner discharge end. An annular disk, affixed to the discharge end, defines a hole. An oxidizer intake delivers oxidizer into the tube. A fuel nozzle delivers fuel into the tube. A cylindrical slotted member has an interrupted outer surface and is disposed within a portion of the tube. The slotted member is affixed to the annular disk and defines an interior void that opens to the hole. The tube and the slotted member define an annular passage therebetween. Elongated slots pass through the outer surface of the slotted member, each directed along a different non-diametrical chord of the slotted member. The elongated slots direct a gaseous stream into the interior void so as to impart both an inwardly-directed radial velocity component and a tangential velocity component to the gaseous stream.

17 Claims, 5 Drawing Sheets

(56) References Cited

U.S. PATENT DOCUMENTS

| | | | | |
|---|---|---|---|---|
| 4,598,553 | A * | 7/1986 | Saito | F23R 3/34 60/733 |
| 4,907,962 | A * | 3/1990 | Azuhata | F23D 1/02 110/262 |
| 5,057,009 | A | 10/1991 | Nechvatal et al. | |
| 5,251,823 | A | 10/1993 | Joshi et al. | |
| 5,460,512 | A | 10/1995 | Lifshits et al. | |
| 5,636,510 | A * | 6/1997 | Beer | F23D 14/24 60/39.23 |
| 5,772,421 | A | 6/1998 | Besik et al. | |
| 5,810,575 | A | 9/1998 | Schwartz et al. | |
| 5,846,067 | A | 12/1998 | Nishiyama et al. | |
| 5,944,507 | A | 8/1999 | Feldermann | |
| 6,755,359 | B2 * | 6/2004 | Sprouse | F23D 11/107 239/405 |
| 6,905,328 | B2 | 6/2005 | Poe | |
| 7,591,648 | B2 | 9/2009 | Mosiewicz | |
| 8,292,615 | B2 | 10/2012 | Spangelo et al. | |
| 8,308,477 | B2 | 11/2012 | Perry et al. | |
| 2005/0279862 | A1 * | 12/2005 | Mao | F23D 11/107 239/403 |
| 2007/0254251 | A1 | 11/2007 | Cao et al. | |
| 2010/0018445 | A1 | 1/2010 | Li et al. | |
| 2010/0330514 | A1 * | 12/2010 | Lam | F23D 14/02 431/12 |
| 2012/0017595 | A1 * | 1/2012 | Liu | F23D 14/02 60/737 |
| 2013/0122440 | A1 | 5/2013 | Zink et al. | |

FOREIGN PATENT DOCUMENTS

| | | |
|---|---|---|
| EP | 2434218 A1 | 3/2012 |
| EP | 1335163 B2 | 5/2012 |
| GB | 2 066 445 | 7/1981 |

OTHER PUBLICATIONS

WIPO: "Notification of Transmittal of the International Search Report and the Written Opinion of the International Searching Authority, or the Declaration"; Jan. 7, 2015.

* cited by examiner

LOW NOX BURNER WITH LOW PRESSURE DROP

BACKGROUND OF THE INVENTION

1. Field of the Invention

The present invention relates to fuel burners and, more specifically, to a burner that produces low NOx levels in industrial heating application where low oxygen is desired.

2. Description of the Related Art

Industrial heating applications utilize thermal processing where elevated temperatures are needed by the burners. Many existing burners generate high temperature flames that cause nitrogen to react with oxygen in the combustion air so as to form mono-nitrogen oxides (referred to as "NOx"), which are pollutants. Some burners employ configurations to reduce heat concentration of the flame, thereby reducing the flame temperature and, thus, reducing the amount of NOx produced during combustion. Many such burners employ complicated systems for combining fuel and combustion air.

Therefore, there is a need for a simple combustion system that produces low NOx levels during combustion even at high flame temperatures.

SUMMARY OF THE INVENTION

The disadvantages of the prior art are overcome by the present invention which, in one aspect, is a burner for burning a fuel and an oxidizer in a gaseous stream. A tube, having an inner dimension, is configured to allow passage therethrough of the gaseous stream. A selected end of the tube terminates in a burner discharge end. A disk is affixed to the burner discharge end of the tube. The disk defines a hole therethrough. An oxidizer intake is configured to deliver the oxidizer into the tube. A fuel nozzle is configured to deliver the fuel into the tube. A slotted member has an interrupted outer surface having an outer dimension and also has a length. The cylindrical slotted member is disposed within a portion of the tube and is affixed to the disk. The slotted member defines an interior void therein that opens to the hole defined by the disk. The outer dimension is less than the inner dimension of the tube thereby defining a passage therebetween. A plurality of elongated slots is defined through the outer surface of the slotted member along the length of the slotted member. Each slot is directed along a different non-diametrical chord of the slotted member and fluidly couples the interior void to the passage so that the plurality of elongated slots direct the gaseous stream from the tube into the interior void of the slotted member so as to impart both an inwardly-directed radial velocity component and a tangential velocity component to the gaseous stream.

In another aspect, the invention is a burner for burning a mixture of a flammable gas and an air stream. A cylindrical tube, having an inner diameter, is configured to allow passage therethrough of an air stream. The cylindrical tube terminates in a burner end. An annular disk defines a hole therethrough affixed to the burner end of the cylindrical tube. An air intake is configured to deliver the air stream into the cylindrical tube. A fuel pipe is in fluid communication with a fuel supply. The fuel pipe includes an end portion defining at least one orifice configured to distribute the flammable gas into the air stream. A cylindrical slotted member, having an outer surface and a length, is disposed within a portion of the cylindrical tube and is affixed to the annular disk. The slotted member defines an interior void therein that opens to the hole defined by the annular disk. The slotted member includes an outer surface having an outer diameter that is less than the inner diameter of the cylindrical tube thereby defining an annular passage therebetween. A plurality of elongated slots is defined through the outer surface of the slotted member along the length of the slotted member. Each slot is directed along a different non-diametrical chord of the slotted member and fluidly couples the interior void to the annular passage so that the plurality of elongated slots direct the air stream from the tube into the interior void of the slotted member so as to impart both an inwardly-directed radial velocity component and a tangential velocity component on the air stream.

In yet another aspect, the invention is a method of burning a mixture of a fuel and an oxidizer, in which at least the oxidizer is directed along a first axis. The fuel is entrained in the oxidizer thereby generating the mixture of the fuel and the oxidizer. The oxidizer is diverted so as to cause the oxidizer to have an inwardly-directed velocity component and a tangentially-directed velocity component corresponding to a plurality of tangents of a circle that is transverse to the first axis. The mixture of the fuel and the oxidizer is ignited.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1B:
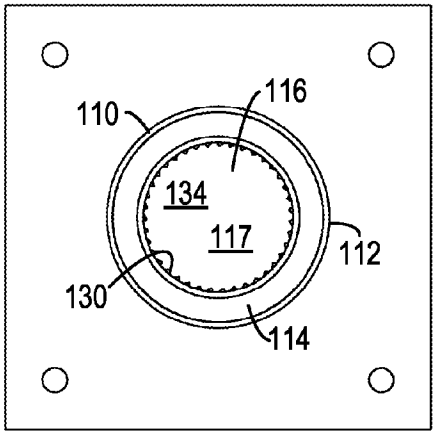
FIG. 1B is an end elevational view of the embodiment shown in FIG. 1A.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 1A:
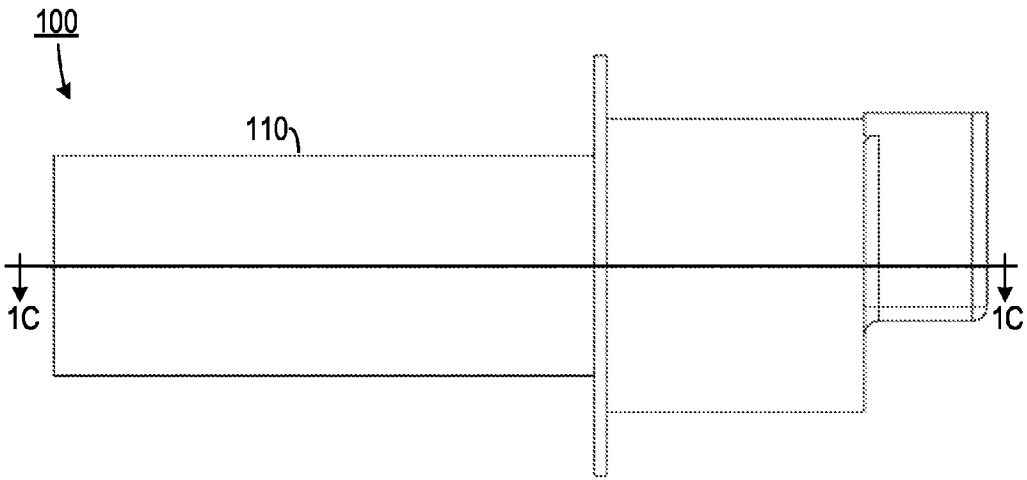
FIG. 1A is a side elevational view of one premix embodiment of a burner.
Figure 1C:
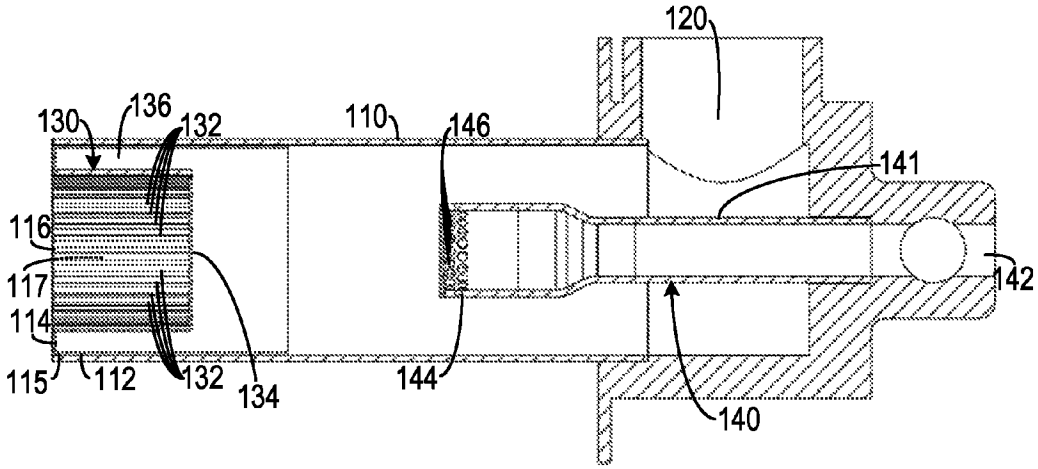
FIG. 1C is a cross sectional view of the embodiment shown in FIGS. 1A and 1B, taken along line 1C-1C.

As shown in FIG. 1, one embodiment of a burner 100 includes a cylindrical tube 112, which may be disposed in tight fitting concentric a sleeve 110. (In certain embodiments, the tube 112 is a portion of the sleeve 110 and is not distinct therefrom.) The tube 112 ends in a burner discharge end 115 to which an annular disk 114 is affixed. The annular disk 114 defines a hole 116 passing therethrough. A cylindrical slotted member 130 is disposed within the tube 112 and is affixed to the annular disk 114. The cylindrical slotted member 130 defines an interior void 117 therein that opens to the hole 116 and has a back wall 134. The slotted member 130 also defines a plurality of elongated slots 132 defined through the outer surface of the slotted member 130 along its length. The outer diameter of the slotted member 130 is less than the inner diameter of the cylindrical tube 112 so that there is an annular passage 136 therebetween. An oxidizer intake 120 delivers an oxidizer (which could be, for example, air, oxygen enriched air, or oxygen of any purity) into the tube 112 and a fuel nozzle 140 delivers a fuel (such as a burnable gas) into the tube 112. The fuel nozzle includes a fuel pipe 141 that is in fluid communication with a fuel supply 142. The fuel pipe 141 includes an end portion 144 that defines a plurality of orifices 146 that distribute the fuel into the oxidizer. In this embodiment, the end portion 144 of the nozzle is disposed outside of the slotted member 132 so that fuel and the oxidizer premix in the gaseous stream prior to entering the slotted member 132.

Figure 2B:
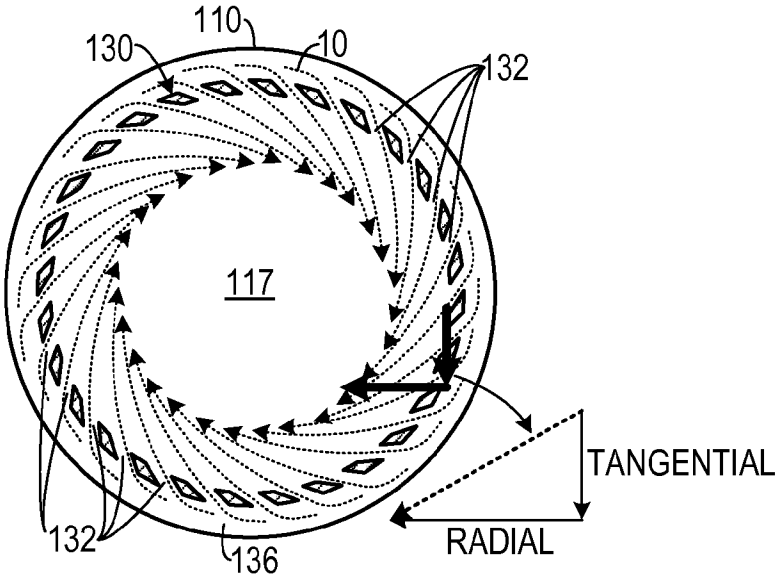
FIG. 2B is a cross sectional schematic end view of the burner shown in FIG. 2A, taken along line 2B-2B, demonstrating flow through the burner.
Figure 2A:
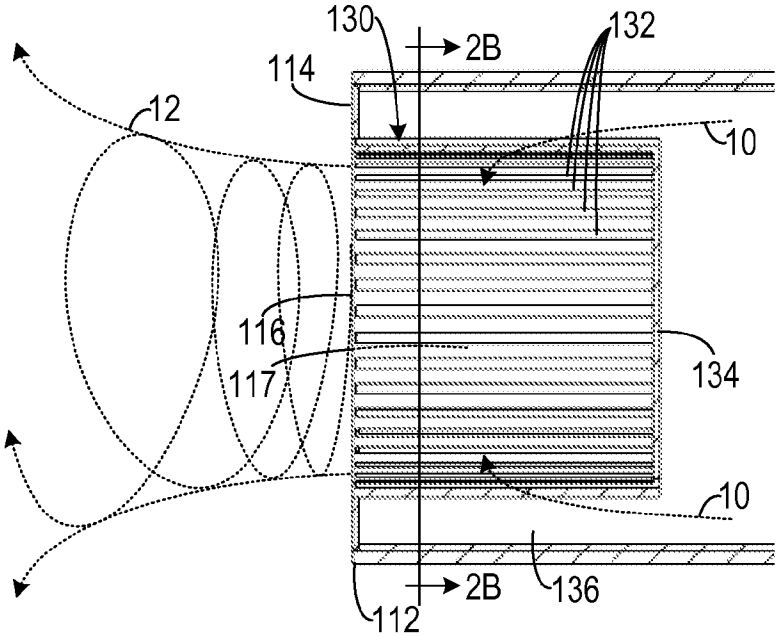
FIG. 2A is a schematic side view of a burner demonstrating flow through the burner.

As shown in FIGS. 2A-2B, each slot 132 is directed along a different non-diametrical chord of the cylindrical slotted member 130 and fluidly couples the interior void 117 to the annular passage 136. As a result, the plurality of elongated slots 132 direct the gaseous stream 10 from inside the cylindrical tube 112 into the interior void 117 of the slotted member 130. This imparts both an inwardly-directed radial velocity component and a tangential velocity component to the gaseous stream 10, which results in a swirling gaseous stream. Once the swirling gaseous stream exits the hole 116, it becomes a radially outwardly growing stream 12.

Figure 3:
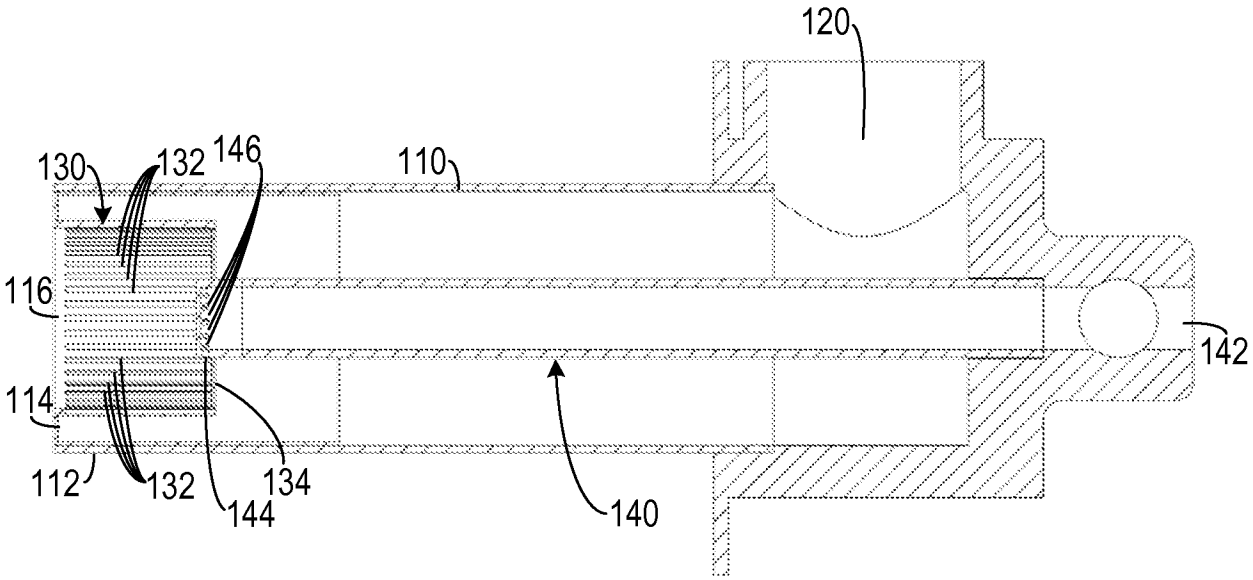
FIG. 3 is a cross sectional view of a non-premix embodiment.
Figure 4:
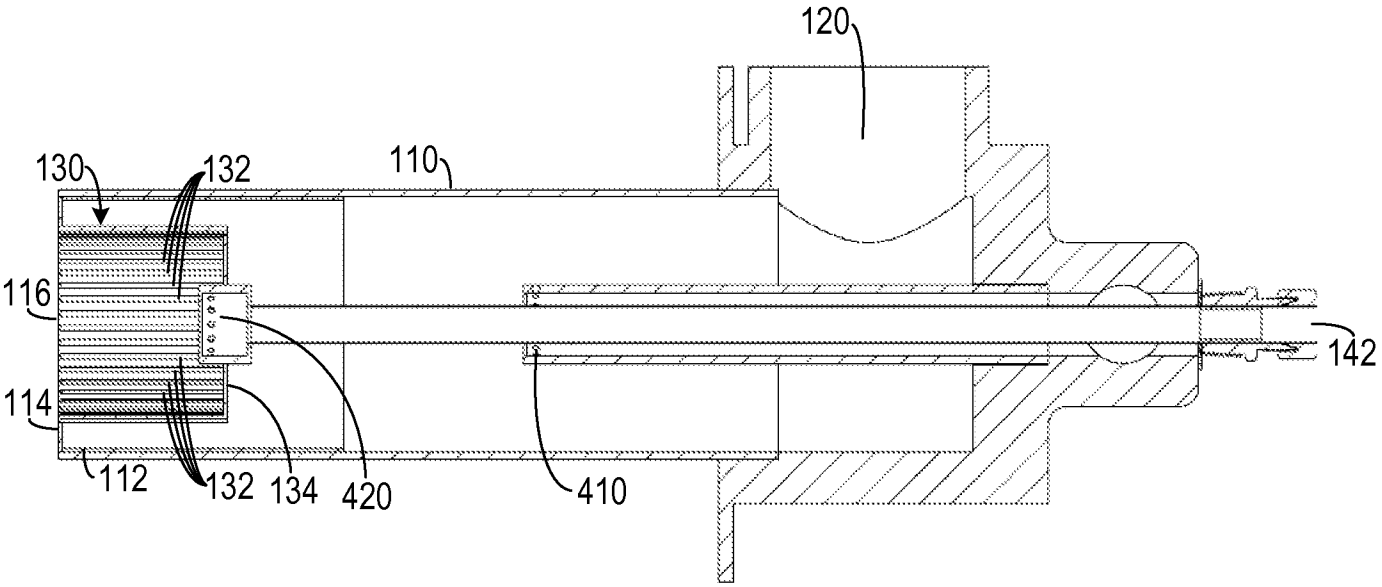
FIG. 4 is a cross sectional view of a hybrid mix embodiment.

As shown in FIG. 3, the end portion 144 of the nozzle 140 can be disposed inside of the slotted member 130 so that the fuel and oxidizer mix inside of the slotted member 130. In another embodiment, the end portion 144 position can be adjusted to any position within the slotted member 140. As shown in FIG. 4, one embodiment allows for a portion of the fuel to premix with the oxidizer by injecting a portion of the fuel into the tube 112 through a first nozzle 410. This portion premixes with the oxidizer prior to entering the slotted member 130. The rest of the fuel is injected directly into the slotted member 130 through a second nozzle 420 and mixes with the balance of the oxidizer inside of the slotted member 130.

Figure 5:
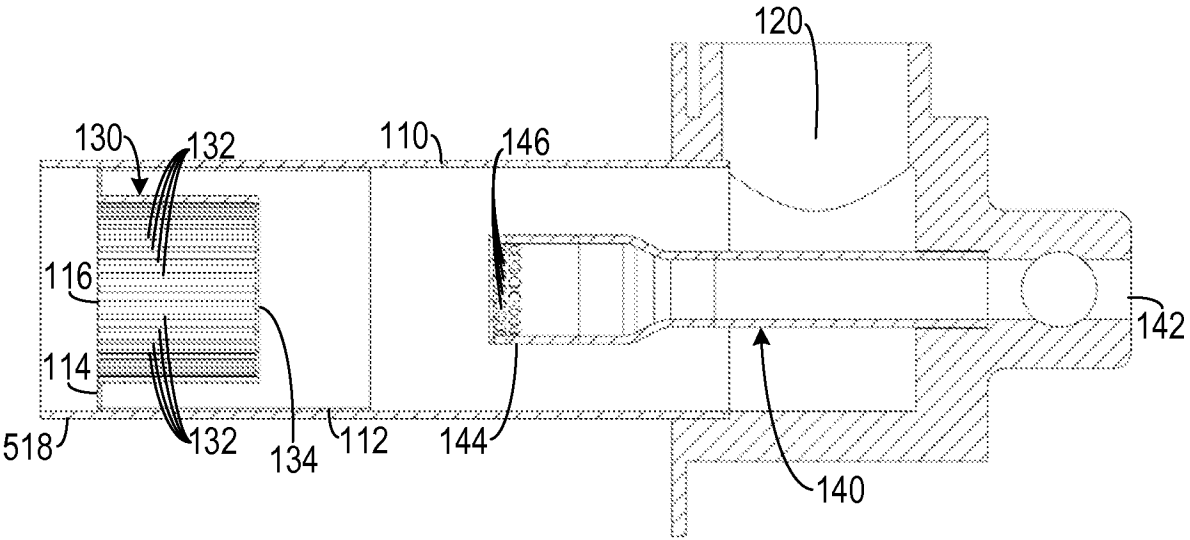
FIG. 5 is a cross sectional view of an adjustable embodiment.

As shown in FIG. 5, the tube 112 can be adjustably moved within the sleeve 110 to be able to adapt to different applications. In one embodiment, the tube 112 is recessed so as to form a lip 518 at the end of the sleeve 110. The tube 112 may be adjusted in the factory and then welded to the sleeve 110. In other embodiments, the position of the tube 112 may be adjusted by the end user during installation. In certain embodiments, the annular disk 114 is welded directly to the sleeve 110 and there is no separate tube; in these embodiments, the entire sleeve is referred to as the tube.

The embodiments disclosed above can be fabricated from any material from which burners are typically constructed. For example, stainless steel can be used. The slotted member 130 can be made by first forming a cylinder from sheet metal and then by milling the slots 132 into the cylinder.

These embodiments direct the oxidizer—or the oxidizer and the fuel—along a first axis along the length of the tube 112. The fuel is entrained in the oxidizer, so as to generate a fuel/oxidizer mixture. At least the oxidizer (and in some embodiments, both the fuel and the oxidizer) are diverted by the slots 132 of the slotted member 130 so as to have an inwardly-directed velocity components and a tangentially-directed velocity components. The mixture is ignited and a flame directed outwardly through the hole 116 is stabilized. The resulting flame expands radially once it escapes the slotted member 130 resulting in enhanced heat transfer followed by fast cooling of the products.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A burner for burning a fuel and an oxidizer in a gaseous stream, comprising:

(a) a tube, having an inner dimension, configured to allow passage therethrough of the gaseous stream, a selected end of the tube terminating in a burner discharge end;

(b) a disk affixed to the burner discharge end of the tube, the disk defining a hole therethrough;

(c) an oxidizer intake configured to deliver the oxidizer into the tube;

(d) a fuel nozzle configured to deliver the fuel into the tube; and (e) a slotted member, having an interrupted outer surface having an outer dimension and a length, the interrupted outer surface spaced apart from the fuel nozzle, the slotted member disposed within a portion of the tube and affixed to the disk, the slotted member terminating in a back wall, the interrupted outer surface and the back wall defining an interior void therein that opens to the hole defined by the disk, the outer dimension being less than the inner dimension of the tube thereby defining a passage therebetween, a plurality of elongated slots defined through the outer surface of the slotted member along at least a portion of the length of the slotted member, each slot directed along a different non-diametrical chord of the slotted member and fluidly coupling the interior void to the passage so that the plurality of elongated slots direct the gaseous stream from the tube into the interior void of the slotted member so as to impart both an inwardly-directed radial velocity component and a tangential velocity component to the gaseous stream, the back wall being impervious to the gaseous stream so that all of the gaseous stream must enter the void only through the plurality of slots and exit the void through the hole in the disk, wherein the fuel nozzle comprises a fuel pipe in fluid communication with a fuel supply, the fuel pipe including an end portion defining at least one orifice configured to distribute the fuel into the oxidizer, wherein the end portion is disposed outside of the slotted member and inside the tube so that fuel and the oxidizer premix in the gaseous stream prior to the gaseous stream entering the slotted member.

2. The burner of claim 1, wherein the fuel nozzle is configured to be adjustably moved axially with respect to the cylindrical slotted member.

3. The burner of claim 1, wherein the fuel nozzle further comprises a mechanism that injects fuel into the tube outside of the slotted member so that a portion of the fuel enters the gaseous stream outside of the slotted member and so that another portion of the fuel enters the gaseous stream inside of the slotted member.

4. The burner of claim 1, wherein the oxidizer comprises air.

5. The burner of claim 1, wherein the fuel comprises a burnable gas.

6. The burner of claim 1, wherein the tube is substantially cylindrical and wherein the slotted member is substantially cylindrical and is coaxial with the tube.

7. A burner for burning a mixture of a flammable gas and an air stream, comprising:

(a) a cylindrical tube, having an inner diameter, configured to allow passage therethrough of an air stream, the tube terminating in a burner end;

(b) an annular disk defining a hole therethrough affixed to the burner end of the tube;

(c) an air intake configured to deliver the air stream into the cylindrical tube;

(d) a fuel pipe in fluid communication with a fuel supply, the fuel pipe including an end portion defining at least one orifice configured to distribute the flammable gas into the air stream, thereby generating a gaseous stream; and (e) a slotted member, having an interrupted outer surface and a length, the interrupted outer surface spaced apart from the fuel nozzle, the slotted member disposed within a portion of the cylindrical tube and affixed to the annular disk, the slotted member terminating in a back wall, the interrupted outer surface and the back wall defining an interior void therein that opens to the hole defined by the annular disk, the slotted member including an outer surface having an outer diameter that is less than the inner diameter of the cylindrical tube thereby defining an annular passage therebetween, a plurality of elongated slots defined through the outer surface of the slotted member along at least a portion of the length of the slotted member, each slot directed along a different non-diametrical chord of the slotted member and fluidly coupling the interior void to the annular passage so that the plurality of elongated slots direct the gaseous stream from the cylindrical tube into the interior void of the slotted member so as to impart both an inwardly-directed radial velocity component and a tangential velocity component on the gaseous stream, the back wall being impervious to the gaseous stream so that all of the gaseous stream enters the void through the plurality of slots and exit the void through the hole in the disk, wherein the end portion of the fuel pipe is disposed inside of the interior void defined by slotted member and inside the cylindrical tube so that flammable gas and the air mix inside the slotted member, wherein the fuel nozzle further comprises a mechanism that injects a portion of the flammable gas into the into the cylindrical tube outside of the slotted member so that the portion of the flammable gas enters the air stream outside of the slotted member and so that another portion of the flammable gas enters the air stream inside of the slotted member.

8. A method of burning a mixture of a fuel and an oxidizer mixed in a gaseous stream, comprising the steps of:

(a) directing at least the oxidizer along a first axis;

(b) entraining the fuel in the oxidizer thereby generating the mixture of the fuel and the oxidizer;

(c) diverting the mixture of the fuel and the oxidizer so as to cause substantially all of the mixture of the fuel and the oxidizer to have an inwardly-directed velocity component and a tangentially-directed velocity component corresponding to a plurality of tangents of a circle that is transverse to the first axis, wherein the adding step comprises the step of causing the fuel and the oxidizer to premix by dispersing the fuel into a stream of the oxidizer prior to the diverting step; and (d) igniting the mixture of the fuel and the oxidizer.

9. The method of claim 8, further comprising the steps of:

(a) premixing a portion of the fuel with the oxidizer by dispersing a first portion of the fuel into a stream of the oxidizer prior to the diverting step; and (b) dispersing a second portion of the fuel into a stream of the oxidizer after the diverting step.

10. The method of claim 8, wherein the diverting step comprises the step of forcing the gaseous stream through a plurality of elongated slots into a void defined by a slotted member, wherein the slotted member has an outer surface and a length disposed within a portion of a tube and the outer surface terminating in a back wall so as to define an interior void therein that opens to the hole defined by an annular disk affixed to an end of the tube, the slotted member including an outer surface having an outer dimension that is less than inner dimension of the tube thereby defining an annular passage therebetween, wherein the plurality of elongated slots are defined through the outer surface of the slotted member along the length of the slotted member, each slot directed along a different non-diametrical chord of the cylindrical slotted member and fluidly coupling the interior void to the annular passage so that the plurality of elongated slots direct the gaseous stream from the tube into the interior void of the slotted member so as to impart both an inwardly-directed radial velocity component and a tangential velocity component on the gaseous stream, the back wall being impervious to the gaseous stream so that all of the gaseous stream must enter the void through the plurality of slots and exit the void through the hole in the disk.

11. The method of claim 8, wherein the oxidizer comprises air and wherein the fuel comprises a flammable gas.

12. A burner for burning a fuel and an oxidizer in a gaseous stream, comprising:

(a) a tube, having an inner dimension, configured to allow passage therethrough of the gaseous stream, a selected end of the tube terminating in a burner discharge end;

(b) a disk affixed to the burner discharge end of the tube, the disk defining a hole therethrough;

(c) an oxidizer intake configured to deliver the oxidizer into the tube;

(d) a slotted member, having an interrupted outer surface having an outer dimension and a length, the interrupted outer surface spaced apart from the fuel nozzle, the slotted member disposed within a portion of the tube and affixed to the disk, the slotted member terminating in a back wall, the interrupted outer surface and the back wall defining an interior void therein that opens to the hole defined by the disk, the outer dimension being less than the inner dimension of the tube thereby defining a passage therebetween, a plurality of elongated slots defined through the outer surface of the slotted member along at least a portion of the length of the slotted member, each slot directed along a different non-diametrical chord of the slotted member and fluidly coupling the interior void to the passage so that the plurality of elongated slots direct the oxidizer from the tube into the interior void of the slotted member so as to impart both an inwardly-directed radial velocity component and a tangential velocity component to the gaseous stream, the back wall being impervious to the oxidizer so that all of the oxidizer must enter the void only through the plurality of slots and exit the void through the hole in the disk (e) a fuel nozzle configured to deliver the fuel into the tube, the fuel nozzle including a fuel pipe in fluid communication with a fuel supply, the fuel pipe including an end portion defining at least one orifice configured to distribute the fuel radially through the orifice into the oxidizer, the end portion disposed inside of the interior void defined by the slotted member and inside the tube so that fuel and the oxidizer mix in the gaseous stream inside the slotted member.

13. The burner of claim 12, further comprising a cylindrical sleeve, concentric with and disposed about the tube.

14. The burner of claim 12, wherein the oxidizer comprises air.

15. The burner of claim 12, wherein the fuel comprises a burnable gas.

16. The burner of claim 12, wherein the tube is substantially cylindrical and wherein the slotted member is substantially cylindrical and is coaxial with the tube.

17. The burner of claim 1, further comprising a cylindrical sleeve, concentric with and disposed about the tube.

* * * * *